United States Patent [19]

Frazier et al.

[11] 4,094,323

[45] June 13, 1978

[54] SMOKING ARTICLE AND METHOD

[75] Inventors: Thomas Cecil Frazier, Hopewell; John Thomas Ashworth, Richmond; Richard Douglas Chumney, Jr., Mechanicsville, all of Va.; René Wilhelm Meyre, Reidsville, N.C.

[73] Assignee: American Brands, Inc., New York, N.Y.

[21] Appl. No.: 656,264

[22] Filed: Feb. 9, 1976

[51] Int. Cl.[2] ..... A24B 3/18; A24D 1/06

[52] U.S. Cl. ..... 131/8 R; 131/140 P

[58] Field of Search ..... 131/8 R, 140 P, 17 R, 131/17 A, 140 R

[56] References Cited

U.S. PATENT DOCUMENTS 3,409,027 11/1968 de la Burde ..... 131/140 P

*Primary Examiner*—Kyle L. Howell

*Assistant Examiner*—V. Millin

*Attorney, Agent, or Firm*—Pennie & Edmonds

[57] ABSTRACT

The method of making expanded and fiberized tobacco stem and stalk materials having increased filling capacity and suitable for use as filler in smoking articles comprising conditioning said stem material by adjusting the moisture content to a level of at least about 10% to about 50% by weight while maintained at a temperature of about 115° to 170° C. and a pressure of about 10 to 100 psig for a period of from about 0.1 to 5 minutes and mechanically fiberizing the thus treated stem material while it is under a pressure of about 10 to 100 psig between fiberizing surfaces maintained from about 0.05 to 0.3 inch apart. The invention also includes smoking articles made from such expanded stem material having increased filling capacity and lowered "tar" and nicotine.

10 Claims, No Drawings

SMOKING ARTICLE AND METHOD

BACKGROUND OF THE INVENTION

Smoking articles, such as cigars, cigarettes, and pipe tobaccos are conventionally made from blends of shredded tobacco lamina, shredded reconstituted tobacco, tobacco shreds, fillers, and mixtures thereof. In addition, the tobacco used will come from varying sources commonly identified as air-cured tobacco, flue-cured tobacco, or mixtures thereof. It has long been desired to use, in addition to the lamina portion of the tobacco leaf, the stem portions which include the mid-ribs, veins, and also the tobacco stalk.

Present tobacco manufacturing procedure includes processing the tobacco leaf through a stemmery which separates the stems, including mid-ribs, from the lamina. The proportion of stems will vary somewhat but generally the stem materials will represent 20 to 25% by weight of the total tobacco leaf. These materials are not presently successfully utilized as such in smoking articles because of their hard, horny nature. In addition, they are generally unsuitable for smoking articles such as cigarettes because of their poor burning properties and because their sharp, hard edges tend to tear the wrapping paper.

Efforts attempted in the past to render the stem materials suitable for use have included passing the stems between rollers which act to crush or disintegrate the stems and/or cutting the stems. This has not been fully satisfactory because the resultant material is still hard and has a very limited filling capacity. In addition, many cross-sectional pieces, or bird's eyes, result together with other woody, sharp pieces which can penetrate the paper wrapper of a cigarette, deform the shape thereof, and which tend not to burn properly.

As to filling capacity, this has been improved by treatment of the stems with water and/or solvents in efforts to expand the same and thereby increase the filling capacity. Where excessive water has been used, this has proven unsuitable since it results in the leaching, and consequently the loss, of the water-soluble materials in the stems, thus adversely affecting the desirable tobacco properties such as smoke flavor and taste. Solvent treatment is also unsuitable in that it may add an element to the tobacco not normally found therein.

SUMMARY OF THE INVENTION

A method for increasing the filling capacity of stem material and treating it so as to make it suitable for use in smoking articles without adversely changing the smoking properties or chemical constitution of the stem material has now been found, as have novel smoking articles utilizing such stem material.

Briefly stated, the present invention comprises the method of making expanded and fiberized tobacco stem and stalk materials having increased filling capacity and suitable for use as filler in smoking articles comprising conditioning said stem material by adjusting the moisture content to a level of at least about 10 to about 50% by weight while maintained at a temperature of about 115° to 170° C. and a pressure of about 10 to 100 psig for a period of from about 0.1 to 5 minutes and mechanically fiberizing the thus treated stem material while it is under a pressure of about 10 to 100 psig between fiberizing surfaces maintained from about 0.05 to 0.3 inch apart. The invention also includes smoking articles made from such expanded stem material having increased filling capacity and lowered "tar" and nicotine.

DETAILED DESCRIPTION

While the process of the instant invention is suitable for use with fiber-structured plant stem materials where it would be desirable to expand such stems and to fiberize them for use in making various smoking articles, it will be described in connection with the treatment of tobacco stem materials. As used herein, the term "stem materials" is meant to include stems, mid-ribs, veins, and the like material which is separated from the tobacco leaf in conventional stemmery processing. Such stem materials are ordinarily about 1 to 3 inches in length. Ordinarily, such stem material comprises about 20 to 25% by weight of the tobacco leaf and, if it can be used, results in significant cost savings. In addition, the smoke from tobacco stem materials has lower nicotine and "tar" content than tobacco lamina and their use in smoking articles, such as cigarettes, is particularly desirable.

The initial step in the process is the conditioning or treatment of the tobacco stem materials under heat and moisture while under pressure to adjust the moisture content and to soften the natural binding materials thereof prior to fiberizing. Typically, stems from the stemmery have a bulk density of about 15 to 23 lbs/ft$^3$ and a moisture content of about 6 to 11%. The moisture content to which the stem material is adjusted is from about 10 to 50% by weight, and pressure used is from about 10 to 100 psig and the temperature about 115° to 170° C. The treatment time will vary dependent upon the particular stem material being treated, as hereinafter described.

Such treatment or conditioning of the tobacco stem material can be carried out in any apparatus capable of subjecting the stems to the necessary pressure, heat, and/or moisture to insure that the stems will arrive at the suitable levels previously set forth. It is preferred to carry out such conditioning under pressure with steam, although hot, moist, or dry gas, such as air, can be used. Steam or moist air is required only if the stem material is not at the proper moisture level before being conditioned. Apparatus that can be used for this purpose may be any pressure digester, such as those conventionally used in the processing of wood chips in paper mills. In accordance with the present invention, the pressure should be maintained about 10 to 100 psig and preferably 25 to 35 psig and the moisture is preferably adjusted to above about 18% by weight. The dwelling time for the stem materials in the digester will vary depending on the particular type of stems used and the temperature; ordinarily, from about 0.1 to 5 minutes and, preferably, 0.5 to 2.5 minutes. Flue-cured stems tend to be "less hard" than burley stems and, accordingly, take the shorter treatment time. In cases where there are mixtures of stem materials such as flue-cured and burley stems, the treatment time should be the longer one required for the burley to assure that all of the stems are properly conditioned.

After conditioning, the stem materials are mechanically fiberized while under pressure. The pressure during such mechanical fiberizing is maintained between about 10 and 100 psig and, preferably, 25 to 35 psig. Apparatus suitable for carrying out this mechanical fiberizing and one which is preferred is the Bauer Bros. Co. revolving disc refiner, although commercially available refiners manufactured by Sprout-Waldron, American Defibrator, or others, can be used. In the Bauer refiner, the stem material is fed between two plates or discs rotating in opposite directions having a face pattern designed to fiberize the material fed therebetween. Such discs are commonly called "fiberizing plates". In a continuous operation, it is preferred to feed the conditioned stems from the digester to the refiner by means of a transfer screw. To refine most effectively in accordance with the present invention, it is required that the stem material contain about 18% by weight moisture.

For the mechanical fiberizing of the stem material, it is preferred to space the fiberizing plates from about 0.05 to 0.3 inch apart, preferably 0.13 to 0.18 inch and, in the case of the Bauer apparatus, the rotational speed for the plates is approximately 1200 rpm. The optimum plate spacing and pattern, digester pressure, and retention time can be readily determined for any combination of equipment and tobacco stem material by changing and/or adjusting the same until the material leaving the refiner has the size and appearance of shredded tobacco lamina; that is, bundles of loosely integrated fibers.

After such mechanical fiberizing, the stem material, now in an expanded and fiberized state, is suitable for use in making smoking articles. It is recognized that the moisture content of the fiberized material, as it emerges from the refiner, can be at a level above that desired for making smoking articles and, in such case, it can be dried to the desired moisture level in any of the conventional tobacco drying systems to reduce the moisture level. The refining results not only in the majority of the stem material having substantially the same physical appearance as tobacco lamina, but a portion will be ground to a dust-like condition. Such tobacco stem dust is separated from the fiberized material before utilizing the stem fibers to make smoking articles. Depending upon the stem material treated, the fiberized stem can comprise up to 70% or more by weight of the original starting material.

In making smoking articles utilizing such fiberized stem materials, they alone can be used as the filler material about which a conventional wrapper, such as a cigarette wrapping paper, is placed or it can be blended in varying amounts, as from 2 to 50% by weight of blends used to make the filler. The percentage stems used depends on the smoke taste and flavor desired by the blender of the cigarettes, it being recognized that stem materials tend to have a strong, sharp tobacco taste. The treated stems can be blended with shredded tobacco lamina, shredded reconstituted tobacco, tobacco substitutes, conventional fillers, and the like conventionally used to make cigarettes. Casing, flavoring and/or other tobacco additives conventionally added to cigarette tobacco may also be used in their usual amounts for their usual effects. In the case of pipe tobaccos, of course, the same blending and amounts of treated stem can be used, but there is no encasing of the tobacco in any wrapper.

While the instant invention has been limited in the description to tobacco stem materials, it has been pointed out that it is also suitable for treatment of those fiber structured resilient portions of the other plant stems and stalks which are or may be used in smoking articles. In addition, tobacco stalks can also be processed in accordance with this invention in such manner and the result is that the fiberized stalks can be blended into smoking articles.

The process of the instant invention not only improves the filling capacity but also the blending and cigarette manufacturing resulting in cigarettes with improved burning characteristics and enhanced smoke taste.

The filling capacity of stems treated in accordance with the present invention will vary dependent upon process conditions and, most importantly, upon the type of tobacco stem. However, in all instances a given tobacco stem material will always exhibit a greatly increased filling capacity when fiberized in accordance with the present invention as opposed to being conventionally rolled cut. The difference in filling capacity in such cases is at least about 20 and as great as 50% or higher as is illustrated in the examples that follow. Of particular significance is the fact that properly processed fiberized stem materials of the present invention have a filling capacity of at least about 5 and preferably about 6 cc/g and higher.

The instant invention will be further described in connection with the examples that follow in which the proportions are set forth by weight unless expressly stated to the contrary.

EXAMPLE 1

A Bauer double revolving disc refining system, manufactured by The Bauer Bros. Co., was used to treat 300 lbs. of dried burley stalks. The refining system included a No. 418 pressurized refiner employing Bauer Plates Nos. 36325 and 36326.

The digester retention time was 5 minutes at 80 psig digester steam pressure and the refiner plate separation was 0.05 inch. The dried stalks when fiberized had long, fluffy fibers.

EXAMPLE 2

The Bauer refining system was used to treat a mixture of 50% burley stems and 50% flue-cured stems (about 1 to 3 inches in length). It had the following equipment specifications:

1. Rotary Valve—12 × 14 × 24 inches
2. Digester—36 inch diameter × 26 feet long
3. Vertical Spool Piece—10 inch diameter
4. Transfer Screw—10 inch diameter × 6 feet long
5. Refiner
   (a) plate: diameter 36 inches, Pattern 36326
   (b) motors, two—500 hp. 1200 rpm.
6. Blow Valve—3 inch diameter
7. Blow Line—4 inch diameter
8. Exhaust Cyclone—40 inch diameter × 6 feet high The entire system was started, pressurized to 30 psig and allowed to warm up for 15 minutes.

The mixture was fed into the rotary valve and from there charged to the digester set at a steam pressure of 30 psig. The retention time in the 26 foot long digester was 2.5 minutes. From the digester, the mixture was then passed through the blow valve into the refiner between plates with the diameter and pattern noted above. The plate clearance was 0.18 inches, the bulk density of the stems charged was about 15 lbs/ft$^3$ and they had a moisture content of approximately 11%.

As the finished, refined stems left the apparatus, they had a moisture content of approximately 18%, and were thereafter dried. The finished, dried product was a combination of some 30% dust, which was removed, and the remaining 70% a +18 mesh fiberized tobacco stem having a product bulk density of approximately 7 lbs.

per cubic foot. This material is suitable for the manufacture of smoking articles.

EXAMPLE 3

Blends of equal parts by weight of flue-cured and burley stems were prepared. One portion was fiberized as in Example 2 and the second portion was treated by the conventional rolled cut process. Table A below shows the comparison of the resultant stem by-products.

TABLE A

| Chemical Analysis: | Fiberized Expanded Stems | Conventional Rolled Cut Stems |
|---|---|---|
| Nicotine, % | 0.57 | 0.68 |
| Total Volatile Bases as Ammonia, % | 0.28 | 0.38 |
| Total Volatile Bases Minus Nicotine, % | 0.22 | 0.31 |
| Sugars, as Dextrose, after Inversion, % | 5.5 | 7.5 |
| Ash, % | 23.3 | 22.7 |
| pH | 5.7 | 5.9 |
| Water Extractables, % | 47.9 | 38.1 |
| Physical Properties: | | |
| Filling Capacity, cc/g | 6.65 | 4.40 |
| Filing Capacity Increase Over Conventional Stems, % | 51.1 | — |
| Flotation Index in Ethyl Acetate, % (Solvent Density = 0.894gm/cc at 25° C.) | 71.4 | 5.4 |
| Cross Sections or Bird's Eyes by Microscopic Examination, % by Wt. | 0 | 46.0 |
| Microscopic Appearance | Shredded or Torn | Clearly Cut with Smooth Edges |

Cigarettes were then prepared using 100% of such treated stem products and their physical properties and smoke analysis are set forth in Table B. The cigarettes were 85 mm in length without filters and used commercial grade cigarette paper.

TABLE B

| Physical Properties: | Fiberized Expanded Stems | Conventional Rolled Cut Stems |
|---|---|---|
| Weight of Cigarettes, Cigarettes/4 oz. | 142.6 | 91.7 |
| Increase Cigarette Yield, % | 55.5 | — |
| Moisture, % | 9.0 | 12.6 |
| Circumference, mm | 24.9 | 24.9 |
| Pressure Drop, cm water | 6.1 | 4.1 |
| Fireholding, % holding fire | 100 | 100 |
| Burning Rate, mg/min. | 80.4 | 75.5 |
| Firmness, mm | 0.91 | 0.93 |
| Smoke Analysis: | | |
| Length smoked, mm | 62 | 62 |
| Puffs/Cigarette | 5.3 | 8.3 |
| "Tar", mg/Cigarette | 7 | 13 |
| "Tar", mg/Puff | 1.3 | 1.6 |
| Nicotine, mg/Cigarette | 0.2 | 0.4 |
| Nicotine, mg/Puff | 0.04 | 0.05 |

In making these comparisons, it is recognized that the cigarettes made from fiberized stems were at a lower moisture level than the conventional rolled cut stem counterparts. This was deemed, however, not to be such a difference so as to result in the much higher increase in cigarette yield and in filling capacity. This is borne out in Examples 4 and 5 wherein the moisture content of the blended cigarettes is identical.

EXAMPLE 4

Cigarettes were prepared from equal parts by weight of commercial tobacco blends and processed tobacco stems. Three lots of cigarettes were prepared; one using fiberized expanded stems prepared in accordance with the procedure set forth in Example 2, one with conventional rolled cut stems, and the third being a control lot with 100% commercial cigarette blend without any stem by-product therein.

Table C below summarizes the chemical analysis and physical properties of the blends.

TABLE C

| | Commercial Cigarette Blend[1] Control | Blend of Commercial Blend[1] and Fiberized Expanded Stems[2] (1:1,w/w) | Blend of Commercial Cigarette Blend[1] and Conventional Rolled Cut Stems[2] (1:1,w/w) |
|---|---|---|---|
| Chemical Analysis: | | | |
| Nicotine, % | 1.87 | 1.25 | 1.34 |
| Total Volatile Bases as Ammonia, % | 0.40 | 0.35 | 0.39 |
| Total Volatile Bases Minus Nicotine, % | 0.21 | 0.24 | 0.25 |
| Sugars as Dextrose After Inversion, % | 13.3 | 8.7 | 10.1 |
| Ash, % | 16.12 | 19.87 | 19.17 |
| pH | 5.50 | 5.50 | 5.60 |
| Water Extractables, % | 60.8 | 55.5 | 55.3 |
| Physical Properties: | | | |
| Filling Capacity, cc/g | 3.93 | 5.18 | 4.35 |
| Filling Capacity Increase of Fiberized Stem Blend Over Conventional Stem Blend, % | | 19.1 | |
| Filling Capacity Increase Of Fiberized Stem Blend Over Commercial Cigarette Blend, % | | 31.8 | |

[1]Commercial cigarette blend including flue-cured, burley, Maryland, oriental, and reconstituted tobaccos, but without expanded tobacco or stem by-products.
[2]Stems used for processing were a blend of equal parts by weight of flue-cured and burley stems.

The physical properties and smoke analysis data of the cigarettes are set forth in Table D.

TABLE D

| | Commercial Cigarette Blend[1] Control | Blend of Commercial Blend[1] and Fiberized Expanded Stems[2] (1:1,w/w) | Blend of Commercial Cigarette Blend[1] and Conventional Rolled Cut Stems[2] (1:1,w/w) |
|---|---|---|---|
| Physical Properties: | | | |
| Weight of Cigarettes, Cigarettes/ 4 oz. | 102 | 109 | 95 |
| Increased Cigarette Yield of Fiberized Stem Blend Over Commercial Cigarette Blend, % | | 6.9 | |
| Increased Cigarette Yield of Fiberized Stem Blend Over Conventional Rolled Cut Stem Blend, % | | 14.7 | |
| Moisture, % | 12.3 | 12.1 | 12.1 |
| Circumference, mm | 25.2 | 24.8 | 25.1 |
| Pressure Drop, cm water | 5.3 | 6.4 | 5.6 |
| Fireholding, % holding fire | 100 | 100 | 100 |
| Burning Rate, mg/min. | 61.6 | 69.5 | 74.3 |
| Firmness, mm | 2.00 | 1.28 | 1.39 |
| Smoke Analysis: | | | |
| Length Smoked, mm | 62 | 62 | 62 |
| Puffs/Cigarette | 9.3 | 7.6 | 8.5 |
| "Tar", mg/Cigarette | 27 | 14 | 19 |
| "Tar", mg/Puff | 2.9 | 1.8 | 2.2 |
| Nicotine, mg/Cigarette | 1.8 | 0.8 | 1.0 |

TABLE D-continued

| | Commercial Cigarette Blend[1] Control | Blend of Commercial Blend[1] and Fiberized Expanded Stems[2] (1:1,w/w) | Blend of Commercial Cigarette Blend[1] and Conventional Rolled Cut Stems[2] (1:1,w/w) |
|---|---|---|---|
| Nicotine, mg/Puff | 0.19 | 0.11 | 0.12 |

[1]Commercial cigarette blend including flue-cured, burley, Maryland, oriental, and reconstituted tobaccos, but without expanded tobacco or stem by-products.
[2]Stems used for processing were a blend of equal parts by weight of flue-cured and burley stems.

These data demonstrate that the blend with stems treated in accordance with the present invention had a 19.1% increase in filling capacity over the blend with the conventional rolled cut stems and a 31.8% increase over the commercial cigarette blend. In addition, 28 more cigarettes per pound of blend can be made from the blend utilizing the stems prepared in accordance with the present invention than with the 100% commercial cigarette blend and 56 more cigarettes as compared with the blend containing the conventional rolled cut stems.

Importantly, there was lower "tar" and nicotine content in the cigarettes containing the stems treated in accordance with the present invention.

EXAMPLE 5

Blends were prepared as in Example 3 and the treated stem properties and the properties of cigarettes made therefrom were tested. The results are set forth in Tables E and F below.

TABLE E

BLEND OF EQUAL PARTS BY WEIGHT OF FLUE-CURED AND BURLEY STEMS

| | Fiberized Expanded Stems | Conventional Rolled Cut Stems |
|---|---|---|
| Chemical Analysis: | | |
| Nicotine, % | 0.57 | 0.68 |
| Total Volatile Bases as Ammonia, % | 0.28 | 0.38 |
| Total Volatile Bases Minus Nicotine, % | 0.22 | 0.31 |
| Sugars, as Dextrose, After Inversion, % | 4.5 | 7.5 |
| Ash, % | 24.0 | 22.7 |
| pH | 5.5 | 5.9 |
| Water Extractables, % | 49.8 | 38.1 |
| Physical Properties: | | |
| Filling Capacity, cc/g | 6.65 | 4.40 |
| Filling Capacity Increase Over Conventional Stems, % | 51.1 | — |
| Flotation Index in Ethyl Acetate, % (Solvent Density = 0.894 gm/cc at 25° C.) | 71.4 | 5.4 |
| Cross-Sections or Bird's Eyes by Microscopic Examination, % by Wt. | 0 | 46.0 |
| Microscopic Appearance | Shredded or Torn | Clearly Cut with Smooth Edges |

TABLE F

Cigarettes: 85 mm length without filters; commercial cigarette paper, 100% stem by-products; manufactured with a blend of equal parts by weight of flue-cured and burley stems

| | Fiberized Expanded Stems | Conventional Rolled Cut Stems |
|---|---|---|
| Physical Properties: | | |
| Weight of Cigarettes, Cigarettes/4 oz. | 125.0 | 91.7 |
| Increased Cigarette Yield, % | 36.3 | — |
| Moisture, % | 12.2 | 12.6 |
| Circumference, mm | 25.0 | 24.9 |
| Pressure Drop, cm water | 4.1 | 4.1 |
| Fireholding, % holding fire | 100 | 100 |
| Burning Rate, mg/min. | 83.6 | 75.5 |
| Firmness, mm | 1.17 | 0.93 |
| Smoke Analysis: | | |
| Length Smoked, mm | 62 | 62 |
| Puffs/Cigarette | 5.7 | 8.3 |
| "Tar", mg/Cigarette | 8 | 13 |
| "Tar", mg/Puff | 1.4 | 1.6 |
| Nicotine, mg/Cigarette | 0.2 | 0.4 |
| Nicotine, mg/Puff | 0.04 | 0.05 |

Again, the vast superiority of the fiberized expanded stems as to tar, nicotine, and cigarette yield is readily apparent.

In the foregoing examples and where used elsewhere in the specification, the filling capacity was measured as described below. It has been found that stem fillers resulting from the present invention have a filling capacity of at least 5 cc/g; significantly higher than that of conventional rolled cut stems.

The filling capacity is measured using a 50 mm diameter open-top cylinder into which a 20 gram sample of the tobacco is placed after being equilibrated at 60% R.H. and 80° F. for 5 days. A piston exerting a force of 1.5 psi pressure is applied to the sample for 3 minutes and the height of the sample in the cylinder is then measured and the filling capacity reported as cc/gram.

While the invention has been described in connection with the preferred embodiments, it is not intended to limit the invention to the particular forms set forth, but, on the contrary, it is intended to cover such alternatives modifications, and equivalents as may be included within the spirit and scope of the invention as defined by the appended claims.

What is claimed is:

1. The method of making expanded and fiberized tobacco stem and stalk materials having increased filling capacity and suitable for use as filler in smoking articles comprising conditioning said stem and stalk materials by adjusting the moisture content to a level of at least about 10 to about 50% by weight while maintained at a temperature of about 115° to 170° C. and a pressure of about 10 to 100 psig for a period of from 0.1 to 5 minutes and mechanically fiberizing the thus treated materials while it is under a pressure of about 10 to 100 psig between fiberizing surfaces maintained from about 0.05 to 0.3 inch apart such that the materials are fiberized and expanded when exposed to ambient conditions.

2. The method of claim 1 wherein the tobacco material is selected from air-cured stem material, flue-cured stem material, or mixtures thereof, the moisture is adjusted to about 18% by weight while under a steam pressure of about 25 to 35 psig, and the mechanical fiberizing is carried out at a pressure of from about 25 to 35 psig to give bundles of fibers of stem material having the physical appearance of shredded tobacco lamina.

3. The method of claim 2 wherein the tobacco stem material is a mixture of flue-cured and air-cured stems, said mixture is treated with steam for about 2.5 minutes at a pressure of 30 psig to adjust the moisture content thereof to a level of about 18% by weight and mechanically fiberizing the thus-treated stems under a pressure of from about 25 to 35 psig between countercurrently rotating fiberizing surfaces maintained about 0.15 inch apart.

4. The method of claim 2 wherein the tobacco stem material is flue-cured stems and the conditioning is carried out under a steam pressure of 30 psig for about 1 minute, to adjust the moisture content of the stems to about 18%, followed by mechanically fiberizing the thus-treated stems under pressure between fiberizing surfaces maintained about 0.15 inch apart.

5. The method of claim 1 wherein steam, hot moist gas, or hot dry gas is used to adjust the moisture content and temperature of the plant stem material.

6. A smoking article having reduced tar and nicotine comprising a filler comprising fiberized tobacco stem material, stalk, or mixtures thereof, encased in a wrapper sheet, said filler comprising fibers of expanded tobacco stem material, stalk, or mixtures thereof having a filling capacity of at least about 5 cc/g and being prepared by the method of claim 1.

7. The smoking article of claim 6 wherein the filler is tobacco stem material which comprises at least about 2% by weight of the filler.

8. The smoking article of claim 6 wherein the filler is tobacco stem material which comprises at least about 2% by weight of the filler with the remainder of the filler selected from shredded tobacco lamina, shredded reconstituted tobacco, tobacco substitute, filler, or mixtures thereof.

9. A cigarette comprising a fiberized filler comprising a tobacco stem material selected from flue-cured stems, air-cured stems, or mixtures thereof and encased in cigarette wrapping paper, said stem material having a filling capacity of at least 6 cc/g and being prepared by the method of claim 1.

10. The method of making expanded and fiberized tobacco stem and stalk materials having increased filling capacity and suitable for use as filler in smoking articles comprising conditioning said stem and stalk materials by adjusting the moisture content to a level of at least about 10 to about 50% by weight while maintained at a temperature of about 115° to 170° C. and a pressure of about 10 to 100 psig for a period of from 0.1 to 5 minutes and mechanically fiberizing the thus treated materials while it is under a pressure of about 10 to 100 psig between fiberizing surfaces maintained from about 0.05 to 0.3 inch apart so that the treated materials have the size and appearance of bundles of loosely integrated fibers and expanded when exposed to ambient conditions.

* * * * *